US010304286B2

(12) United States Patent
Lim et al.

(10) Patent No.: US 10,304,286 B2
(45) Date of Patent: May 28, 2019

(54) MEDAL CIRCULATION DEVICE AND AMUSEMENT MACHINE USING THEREOF

(71) Applicant: ANDAMIRO CO., LTD., Gyeonggi-do (KR)

(72) Inventors: Myoung Soo Lim, Seoul (KR); Soo Min Park, Seoul (KR)

(73) Assignee: ANDAMIRO CO., LTD., Gyeonggi-do (KR)

( * ) Notice: Subject to any disclaimer, the term of this patent is extended or adjusted under 35 U.S.C. 154(b) by 238 days.

(21) Appl. No.: 15/338,672

(22) Filed: Oct. 31, 2016

(65) Prior Publication Data

US 2018/0122186 A1 May 3, 2018

(51) Int. Cl.
*A63F 9/24* (2006.01)
*G07F 17/32* (2006.01)

(52) U.S. Cl.
CPC ..... *G07F 17/3248* (2013.01); *G07F 17/3211* (2013.01); *G07F 17/3246* (2013.01)

(58) Field of Classification Search
CPC ..... G07F 17/3248; G07F 17/3246; G07F 17/3211
See application file for complete search history.

(56) References Cited

U.S. PATENT DOCUMENTS 4,662,636 A * 5/1987 Crompton ..... A63F 5/04 273/138.2
5,121,919 A * 6/1992 Martti ..... G07F 17/3297 273/118 A
5,713,572 A * 2/1998 Hagiwara ..... A63F 7/02 273/138.1
5,775,691 A * 7/1998 Hamano ..... G07F 17/3297 273/138.2
5,788,230 A * 8/1998 Krise ..... A63F 7/022 273/120 A
5,951,009 A * 9/1999 Miyamoto ..... G07F 17/3297 273/121 B
7,267,615 B2 * 9/2007 Rodden ..... G07F 17/3297 273/138.3
7,971,880 B2 * 7/2011 Niwa ..... G07F 17/3297 273/138.1

(Continued)

FOREIGN PATENT DOCUMENTS

KR 100609628 B1 * 7/2006 ..... G07F 17/3216

OTHER PUBLICATIONS

Koo et al., KR-100609628 B1. English Machine Translation. Accessed Sep. 14, 2018.*

(Continued)

*Primary Examiner* — Dmitry Suhol
*Assistant Examiner* — Carl V Larsen
(74) *Attorney, Agent, or Firm* — The PL Law Group, PLLC

(57) ABSTRACT

A medal circulation device has a structure in which a medal put into a medal inlet at an upper portion drops along a medal-dropping plate, is collected through a medal outlet at a lower portion after dropping, and is then returned to the medal inlet by a medal circulation plate. The medal circulation device includes: a guide unit for guiding medals put inside through the medal inlet of the m medal-dropping plate; and one or more pins for changing the directions of the medals dropping through the guide unit, so medals are uniformly supplied by the medal circulation plate rotating at a constant speed.

18 Claims, 14 Drawing Sheets

(56) References Cited

U.S. PATENT DOCUMENTS

| | | | | |
|---|---|---|---|---|
| 2004/0178574 | A1* | 9/2004 | Pierce | A63F 7/022 273/139 |
| 2005/0051951 | A1* | 3/2005 | Benevento | A63B 67/02 273/120 R |
| 2005/0101388 | A1* | 5/2005 | Hattori | G07F 17/3211 463/46 |
| 2008/0280661 | A1* | 11/2008 | Shoemaker, Jr. | A63F 9/0247 463/7 |
| 2009/0137303 | A1* | 5/2009 | Halliburton | G07F 17/3295 463/17 |
| 2009/0318207 | A1* | 12/2009 | Okuaki | G07F 17/3297 463/2 |
| 2014/0235356 | A1* | 8/2014 | Yamane | G07F 17/32 463/42 |
| 2017/0092077 | A1* | 3/2017 | Lim | G07F 17/3297 |
| 2017/0109961 | A1* | 4/2017 | Fridrich | A63F 5/045 |

OTHER PUBLICATIONS

Koo et al., KR-100609628 B1. English Abstract. Accessed Sep. 14, 2018.*

* cited by examiner

MEDAL CIRCULATION DEVICE AND AMUSEMENT MACHINE USING THEREOF

BACKGROUND

Field of the Invention

The present invention relates to a medal supply device for amusement machines and, more particularly, to a medal circulation device that has a medal circulation structure in which a medal circulation plate is disposed around a fixed metal seat.

Description of the Related Art

In general, a medal game machine, as shown in FIG. 1, includes a medal circulation device 50, in which a game progresses in a way that the medal circulation device dispenses a plurality of medals, the medals come into contact with a plurality of sensors while dropping, and a score is provided, whereafter a bonus game is started or a gift is provided in accordance with signals from the sensors.

According to the medal circulation device 50 of the related art, when a motor 52 is operated, a foldable link 54 eccentrically coupled to a rotary cam 51 pushes medals 1 dispensed to a medal dispenser lane into a medal circulation lane one by one by moving forward and backward.

The uppermost medal of the medals sequentially arranged in the medal circulation lane 53 drops every time medals are pushed one by one into the medal circulation lane by the foldable link 54.

However, the medal circulation device 50 of the related art has a structural problem in that while the medals 1 are pushed into the medal circulation lane 53 from the medal dispenser lane 56, they are frequently stuck between the exit of the medal dispenser lane 56 and the free end of the foldable link 54.

When a medal 1 is stuck between the exit of the medal dispenser lane 56 and the free end of the foldable link 54, the foldable lane stops moving forward and backward and the medals are no longer carried, whereby the game is stopped. If this state continues, it causes problems, for example, the motor 52 is consequently damaged and the lifespan of the motor 52 decreases, and also it is required to separate the medal circulation device 50 in order to remove the medal stuck between the exit of the medal dispenser lane 56 and the free end of the foldable link 54.

Further, medal-dropping plates in the related art have a simple structure of changing the direction of dropping medals using pins, so users cannot enjoy the game for a long period of time.

Further, medals that drop on medal-dropping plates contaminate a medal sensing unit such that the medal sensing unit cannot sense the medals, thus necessitating frequent repair of the machine.

Further, since the medal game machines provide only a game for getting medals, it alone is not enough to arouse user interest.

SUMMARY

In order to solve these problems, an aspect of the present invention is to provide a medal circulation device that automatically supplies a medal to a medal circulation plate that is rotating.

Another aspect of the present invention is to provide a medal circulation device having a rotary guide at a medal inlet.

Another aspect of the present invention is to provide a medal circulation device having rollers for stable rotation of a medal circulation plate.

Another aspect of the present invention is to provide a medal circulation device including medals that can be accurately sensed.

Another aspect of the present invention is to provide an amusement machine using a medal circulation device having a game plate that allows a user to enjoy a game using medals supplied by the medal circulation device.

In order to achieve the above aspect, according to one aspect of the present invention, there is provided a medal circulation device that includes: a support frame; a medal-dropping plate coupled to the support frame and having a medal inlet and a medal outlet; and a medal circulation plate collecting medals discharged through the medal outlet and putting the medals into the medal inlet, in which the medal includes a magnetic member and a bracket covering the magnetic member.

The medal-dropping plate may include: a guide unit guiding medals put into the medal inlet; and one or more pins changing directions of medals dropping through the guide unit.

The guide unit may include a pair of first and second guides, and the first guide and the second guide may be turned left and right about shafts by the motor on the rear side of the medal-dropping plate.

The device may include one or more rollers arranged along the outer circumferential side of the medal circulation plate and the medal circulation plate rotates with the outer circumferential side in contact with the rollers.

There is provided an amusement machine using a medal circulation device, the machine including: a medal circulation device giving a score when a dropping medal passes a detector and returning the dropped medal to drop the medal again; a medal supply unit supplying a medal corresponding to a passing score given by the medal circulation device; and a game plate for playing a game with the medal supplied from the medal supply unit.

The medal circulation device may include: a medal-dropping plate having a medal inlet, a guide unit guiding medals put into the medal inlet, one or more pins changing directions of medals dropping through the guide units, and a medal outlet discharging medals passing through the pins; and a medal circulation plate collecting the medals discharged through the medal outlet to return the medals into the medal inlet.

The game plate may include: a collecting plate collecting medals supplied from the medal supply unit; a pusher pushing and discharging medals collected on the collecting plate; and a medal dispenser dispensing the medals pushed and discharged by the pusher.

According to the medal circulation device of an embodiment of the present invention, medals are uniformly supplied by the medal circulation plate rotating at a constant speed.

Further, according to the medal circulation device of the present invention, since the directions of the medals put inside through the medal inlets are randomly changed by the turning guides, a more interesting game can be provided.

Further, since the medal circulation plate rotates with the outer circumferential surface stably supported by the rollers, it is possible to reduce wear and frequency of malfunction.

Further, according to the medal circulation device of the present invention, since the medals are made of a magnetic substance and the medals are sensed on the basis of the magnetism, it is possible to accurately sense the medals, so it is possible to use the medal for a long period of time without repair of the machine.

According to the present invention a user can enjoy a game primarily through the medal circulation device and enjoy another game using a medal obtained as a result of the game, so the user can actively enjoy the medal circulation device game and possible enjoy several other games with won medals.

BRIEF DESCRIPTION OF THE DRAWINGS

The above and other objects, features and other advantages of the present invention will be more clearly understood from the following detailed description when taken in conjunction with the accompanying drawings, in which.

DETAILED DESCRIPTION

The terms and words used in the present specification and claims should not be interpreted as being limited to typical meanings or dictionary definitions, but should be interpreted as having meanings and concepts relevant to the technical scope of the present invention based on the rule according to which an inventor can appropriately define the concept of the terms to describe most appropriately the best method he or she knows for carrying out the invention.

Further, throughout the specification, unless explicitly described otherwise, "comprising" any components will be understood to imply the inclusion of other components rather than the exclusion of any other components. Further, in the specification, the terms "~ unit", "~ er", "module", and "device" mean one unit for processing at least one function or operation and may be achieved by hardware, software, or a combination of hardware and software.

The term "and/or" used throughout the specification should be understood as including all of combination that can be made from one or more relevant items. For example, the term "the first item, the second item, and/or the third item" means not only the first, the second, or the third item, but the combination of all of items that can be made from two or more of the first, second, or third items.

A medal circulation device according to an embodiment of the present invention is described hereafter with reference to the drawings.

Figure 2:
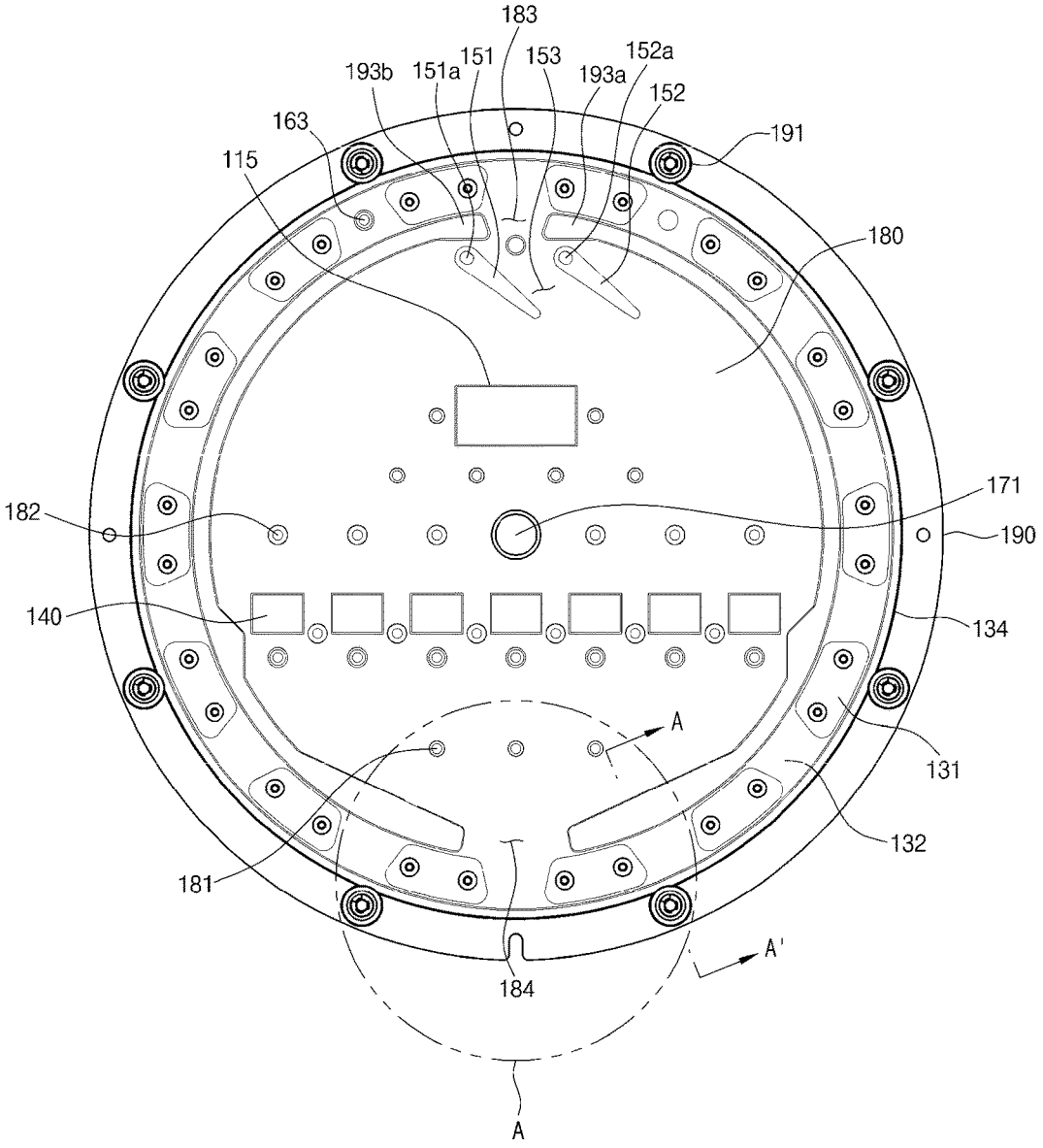
FIG. 2 is a plan view of a medal circulation device according to an embodiment of the present invention.
Figure 3:
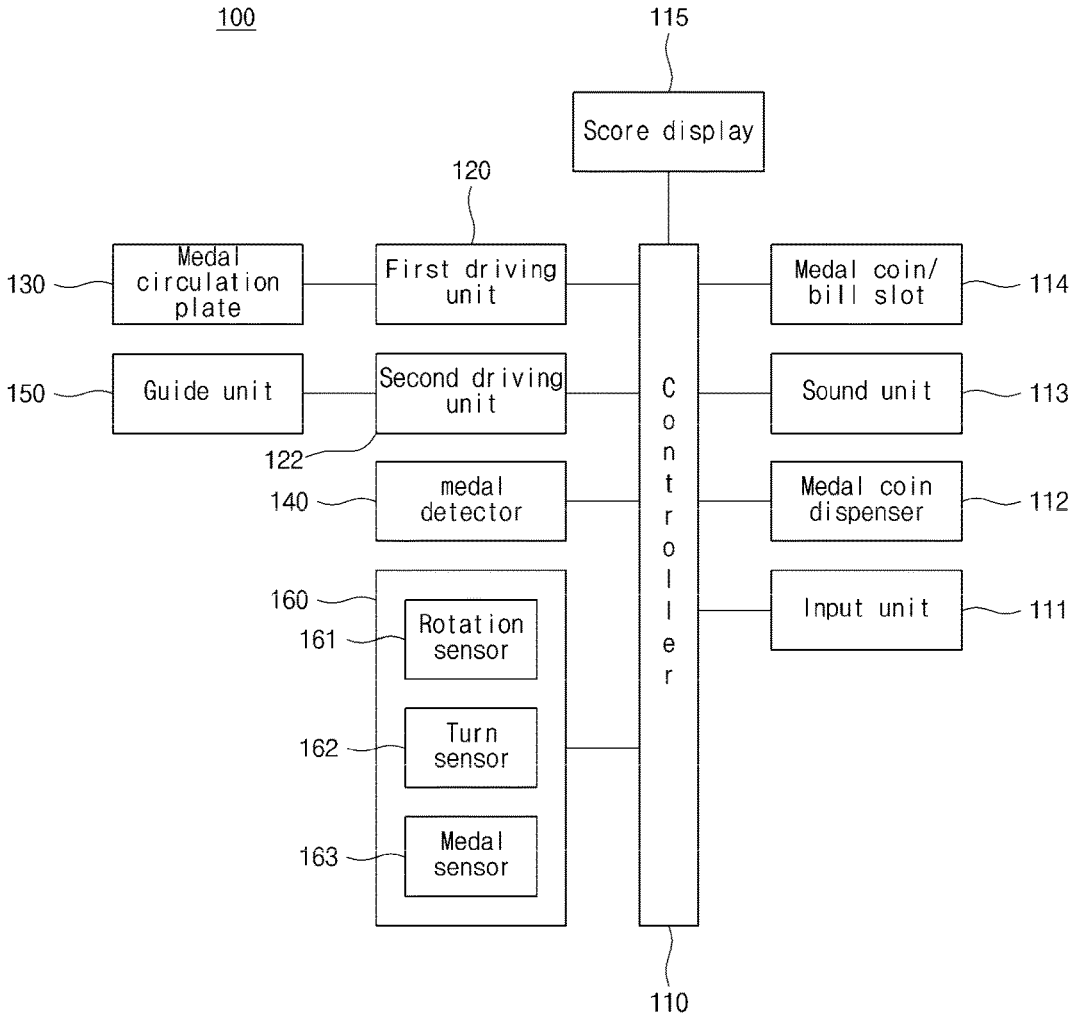
FIG. 3 is a view showing the main structure of the medal circulation device.

FIG. 2 is a plan view showing a medal circulation device according to an embodiment of the present invention and FIG. 3 is a view showing the main configuration of the medal circulation device. As shown in the figures, according to a medal circulation device 100 of the present invention, a medal circulation plate 130 is disposed around outside a medal-dropping plate 180 that is fixed, so medals 300 discharged from a medal outlet 184 formed at a lower portion of the medal-dropping plate 180 sequentially go into medal seats 132 formed on the medal circulation plate 130 and are rotated and delivered, and when the medals 300 in the medal seats 132 are delivered to an upper portion of the medal-dropping plate 180, they naturally drop into a medal inlet 183.

A medal delivery lane 133 is formed between the outer circumferential side of the medal-dropping plate 180 and a support frame 190 so that the medal circulation plate 130 rotates along the medal delivery lane 133.

Figure 5:
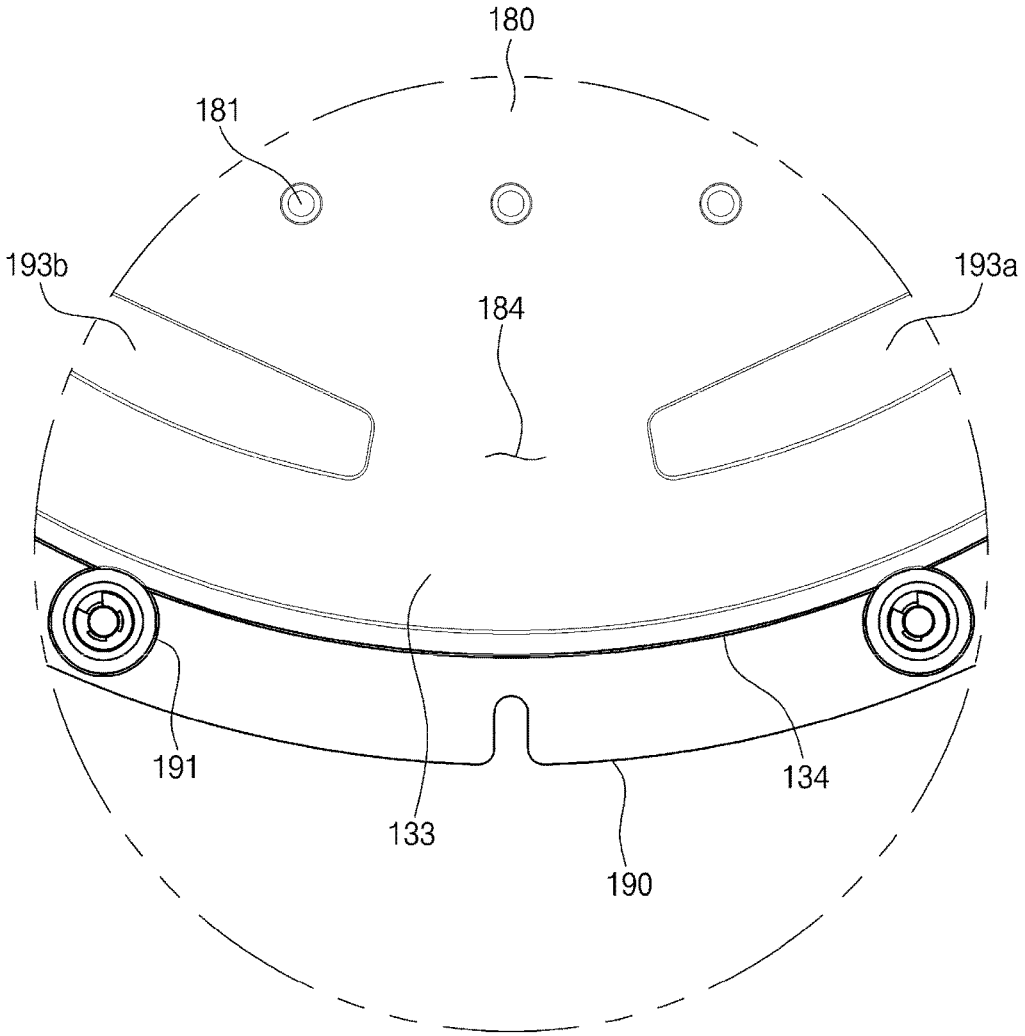
FIGS. 5 and 6 are enlarged views of a medal circulation plate.

Referring to an enlarged view of FIG. 5 showing a portion of the medal circulation plate, the medal delivery lane 133 is formed between the support frame 190 and a pair of support brackets 193*a* and 193*b* formed along the outer circumference side of the medal-dropping plate 180.

In detail, the pair of support brackets 193*a* and 193*b* are spaced by the width of the medal delivery lane 130 inside from the outer circumferential side of the circular support frame 190, and the medal delivery lane 130 is defined by the bottom of the medal-dropping plate 180, the support brackets 193*a* and 193*b*, and a stepped portion 192 protruding upward along the outer circumferential side of the support frame 190.

The support bracket 193 and 193*b* are each formed substantially in a semicircular shape and are formed on the support frame with the ends spaced from each other such that the upper gap becomes a medal inlet 183 and the lower gap becomes a medal outlet 184.

Figure 4:
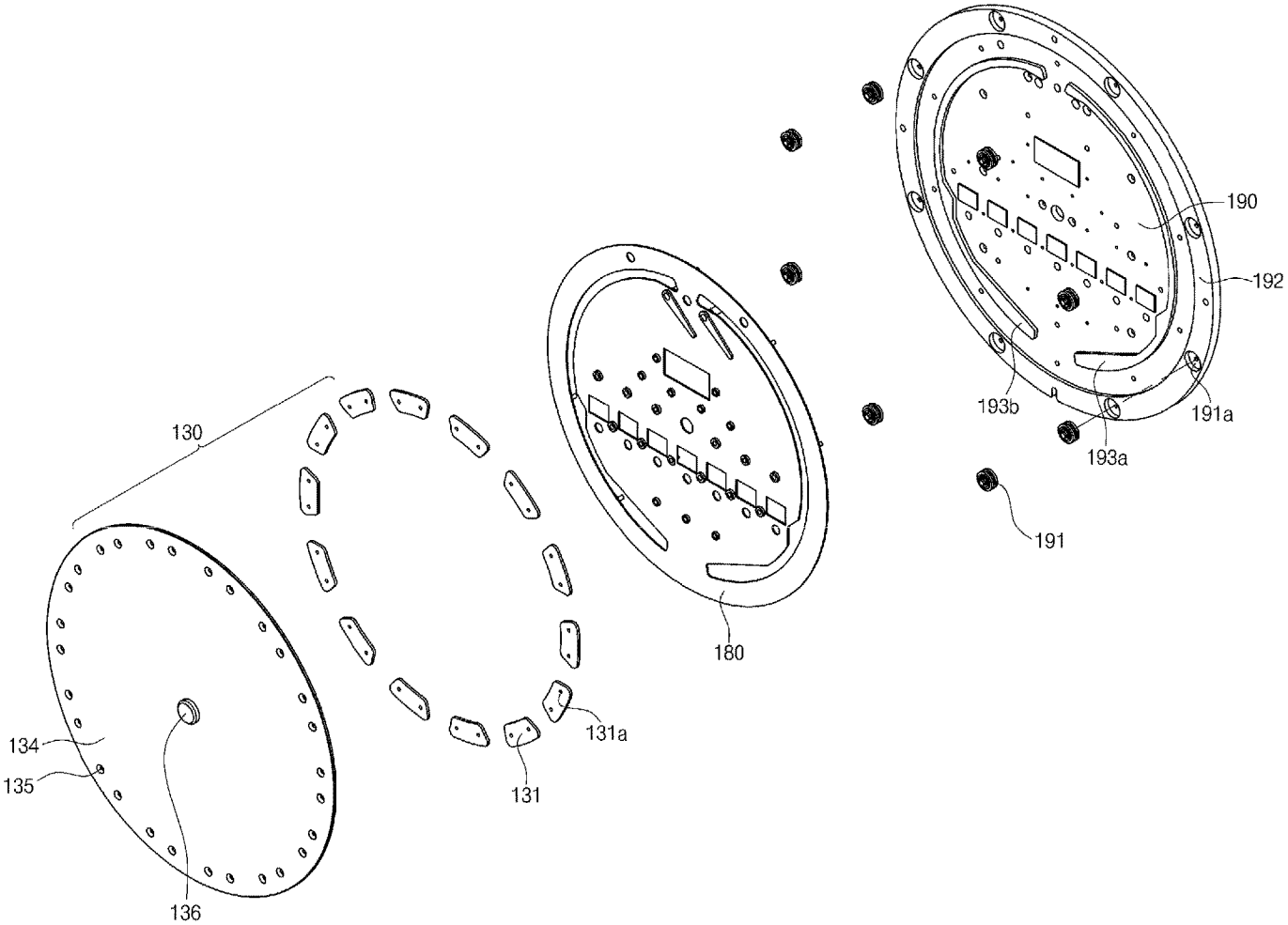
FIG. 4 is an exploded perspective view of the medal circulation device.

Referring to FIG. 4 that is an exploded perspective view of the medal circulation device, the support frame 190 is a circular plate for supporting the medal circulation device of the present invention, in which the stepped portion having holes 191*a* for fastening rollers 191 is formed around the outer circumferential side and the support brackets 193*a* and 193*b* protrudes thereon as high as the height of the stepped portion 192.

The medal-dropping plate 180 is fixed on the support frame 190, the rollers 191 are fastened around the outer circumferential side of the support frame 190, and a transparent cover 134 for covering the medal-dropping plate 180 is disposed over the medal-dropping plate 180.

As a result, the medal delivery lane 133 is defined in a shape having a rectangular cross-section formed by the medal plate 180 that is the bottom, the outer sides of the support brackets 193*a* and 193*b* that make the inner side, the inner side of the stepped portion 192 that is the outer side, and the transparent cover 134 that is the top.

Figure 7:
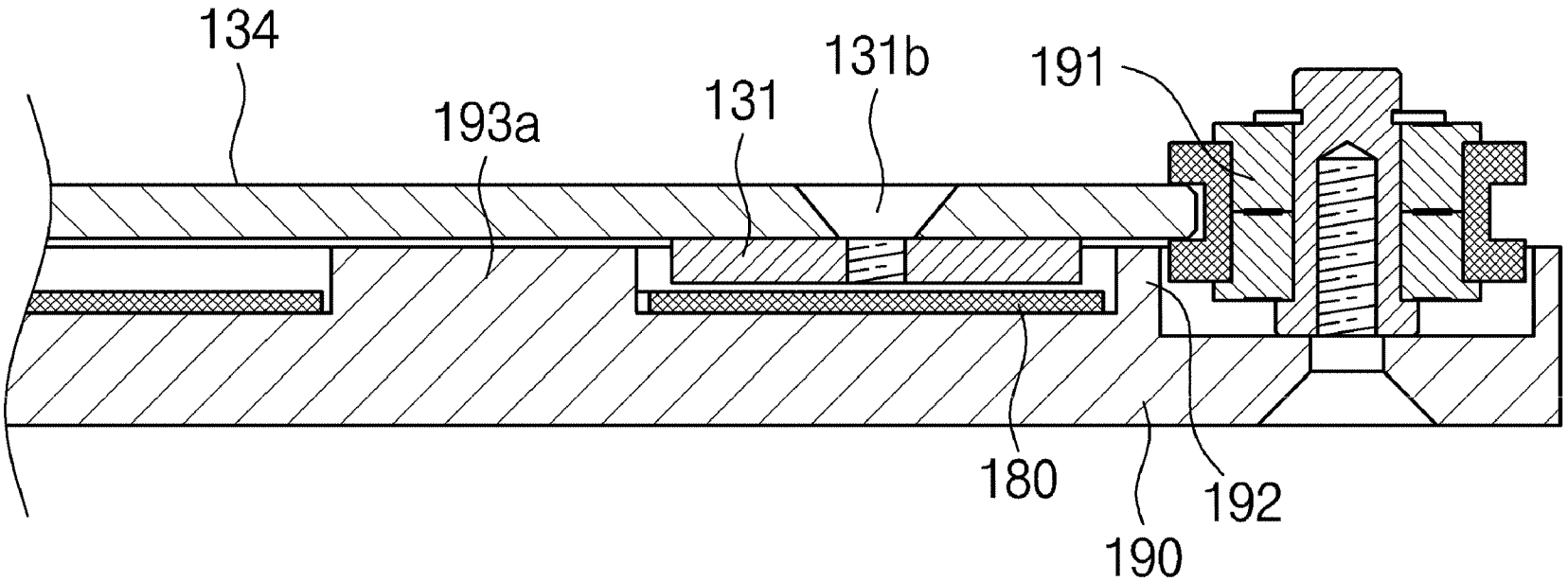
FIGS. 7 and 8 are cross-sectional views of the medal circulation plate.
Figure 8:
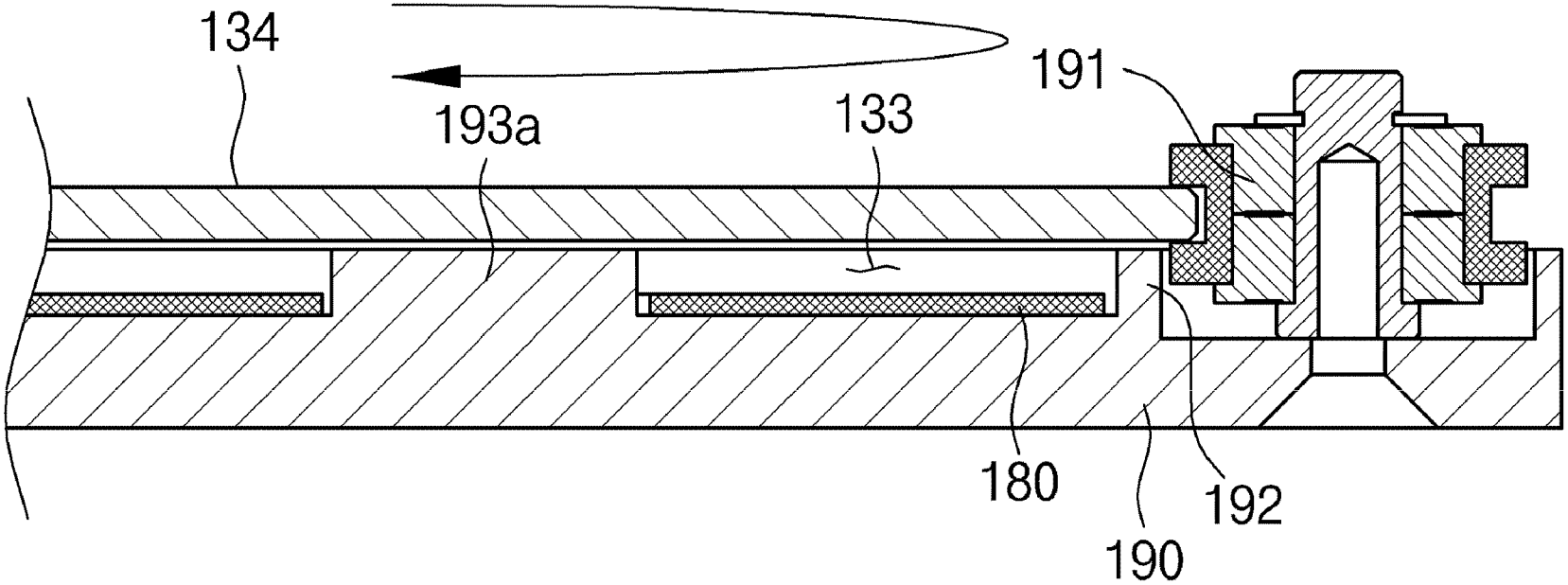

Referring to FIGS. 7 and 8 that are cross-sectional views of the medal circulation plate, it can be seen the medal delivery lane 133 having a rectangular cross-section is formed by the medal-dropping plate 180 for the bottom, the outer side of the support bracket 193*a* for the inner side, the inner side of the step 192 for the outer side, and the transparent cover 134 for the top.

Further, the medal-dropping plate 180 has a guide unit 150 that guides medals supplied inside through the medal inlet 183, one or more pins 182 that change the direction of medals dropping through the guide unit 150, and one or more medal detectors 140 that sense medals dropping with the direction changed by the pins 182 and in which a passing score is set.

The medal circulation plate 130 is connected through a shaft to a motor (not shown) disposed on the rear side of the medal-dropping plate 180 and is composed of the circular transparent cover 134 disposed over the medal-dropping plate 180, one or more brackets 131 arranged with regular intervals along and under the outer circumferential side of the transparent cover 134, and fasteners 137 for coupling the transparent cover 134 and the brackets 131.

According to the medal circulation device having the configuration described above of the present invention, when a medal 300 in a medal seat 132 of the medal circulation plate 130 that is rotating is rotated and supplied into the medal inlet 183 at the upper portion of the medal-dropping plate 180, the medal 300 drops and passes a medal detector 184 with the dropping direction changed primarily by the guide unit 150 that turns left and right and then changed secondarily by the pins 182. Thereafter, the medal 300 that has passed the medal detector 140 goes back into a medal seat 132 of the medal circulation plate 130 through the medal outlet 184, delivered upward, and is then supplied into the medal inlet, whereby medals are circulated in this way.

The medal circulation plate 130 is disposed between the medal-dropping plate 180 and the support frame 190 to be rotatable along the medal delivery lane 133, and the medal seats 132 are sequentially formed in a substantially semi-circular shape on the medal circulation plate 130.

The components of the medal circulation plate 130 may be all made of acryl or stainless steel so that the medal circulation plate can smoothly rotate without interference along the medal delivery lane 133.

Further, a plurality of rollers 191 for supporting the medal circulation plate 130 that is being rotated is coupled to the support frame 190, so the medal circulation plate 130 can be stably supported and rotated by the roller 191.

That is, the medal circulation plate 130 can be stably rotated with the outer side of the transparent cover 134 in contact with the rollers 191.

The medals 300 dropping through the medal outlet 184 sequentially go into the medal seats 132, respectively, of the medal circulation plate 130. Thereafter, the medals 300 inserted in the medal seats 132 are rotated upward with the rotating medal circulation plate along the medal delivery lane and then supplied into the medal inlet 183 one by one.

That is, as the medal circulation plate 130 is rotated, the medals 300 dropping through the medal outlet 184 naturally go into the medal seats 132 every time the medal seats 132 pass the medal outlet 184.

To this end, referring to FIG. 3 showing the main configuration of the medal circulation device, the medal circulation device includes a first driving unit 120 that drives the medal circulation plate 130 at a predetermined speed, a second driving unit 122 that turns the guide unit 150 to the left and right, a score display unit 115 that shows scores made by passing the medal detectors 140, an input unit 114 that has various buttons for operating the medal circulation device, a medal coin dispenser 112, a sound unit 113, a medal coin/bill slot 114, and a controller 110 that controls operation of the medal circulation device.

The medal circulation device of the present invention may further include a sensor unit 160 for sensing whether the medal circulation plate 130 and the guide unit 150 are operated or not.

A sensor for sensing a medal and a coin or a bill for a game or a well-known bill detector for sensing a bill or a substitute bill may be disposed at the medal coin/bill slot 114.

That is, when a signal for starting the game is sensed at the medal coin/bill slot 124, the controller 110 rotates the medal circulation plate 130 and turns the guide unit 150 to the left and right to be ready for starting the game.

After the game ends, the controller 110 may keep the score displayed on the score display 115 or dispenses a medal through the medal coin dispenser 112.

That is, as the medal circulation plate 130 is rotated by the controller 110, a medal in a medal seat 132 is supplied into the medal inlet 183 and then passes a medal detector 140 with the direction changed by the guide unit 150 turning left and right and the pins 182, in which a score set in the medal detector 140 is displayed on the score display 115. Further, after the game ends, the controller 110 keeps the accumulated score displayed on the score display 115 or dispenses a medal through the medal coin dispenser 112.

The medal circulation plate 130 is rotated along a medal lane between the outer circumferential side of the medal-dropping plate 180 and the support frame 190 by the first driving unit 120 including a motor and disposed on the rear side of the medal-dropping plate 180.

Further, the medal circulation plate 130 has the medal seats 132 for holding medals discharged out of the medal outlet 184, so medals held in the medal seats 132 are rotated along the medal lane.

Figure 6:
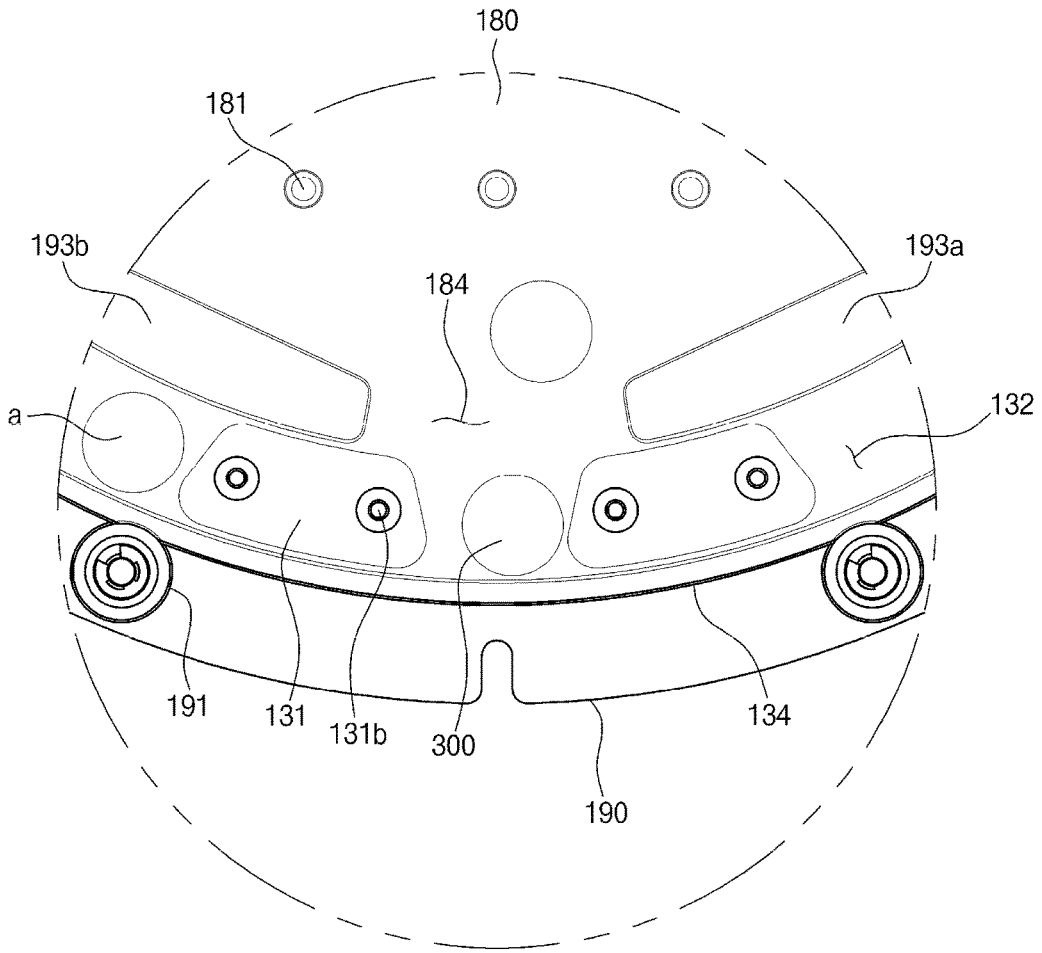

Referring to FIG. 6 that is an enlarged view of a portion of the medal circulation plate, the medal lane 192 is formed between the outer circumferential side of the medal-dropping plate 180 and the support frame 190 so the medals 300 coming out of the medal outlet 184 of the medal-dropping plate 180 are rotated in the medal seats 132.

The medal seats 132 are each formed between the brackets 131 arranged with regular intervals on the medal circulation plate 130 and the brackets 131 are formed substantially in a diamond shape so that medals can be placed at both sides.

Accordingly, the medals 300 placed in the medal seats 132 can be stably delivered without slipping out in spaces defined by the support frame 190, the medal-dropping plate 180, the rollers 191, and the transparent cover 162.

In particular, one or more rollers 191 are disposed on the support frame 190 around the outer circumferential side of the medal circulation plate 130 to allow the medal circulation plate 130 to slide to rotate.

The guide unit 150 is disposed under the medal inlet 183 and is composed of a first guide 151 and a second guide 152 spaced at a predetermined distance from each other such that the medals 300 are supplied through a medal supply passage 153 defined by the first guide 151 and the second guide 152.

The guide unit 150 turns the first guide 151 and the second guide 152 to the left and right about shafts while maintaining the medal supply passage 153 so that the medals supplied inside drop with the direction changed in accordance with the turning direction of the guides.

The guide unit 150 is also turned about eccentric shafts by a second driving unit 122 such as the motor on the rear side of the medal-dropping plate 180.

Figure 1:
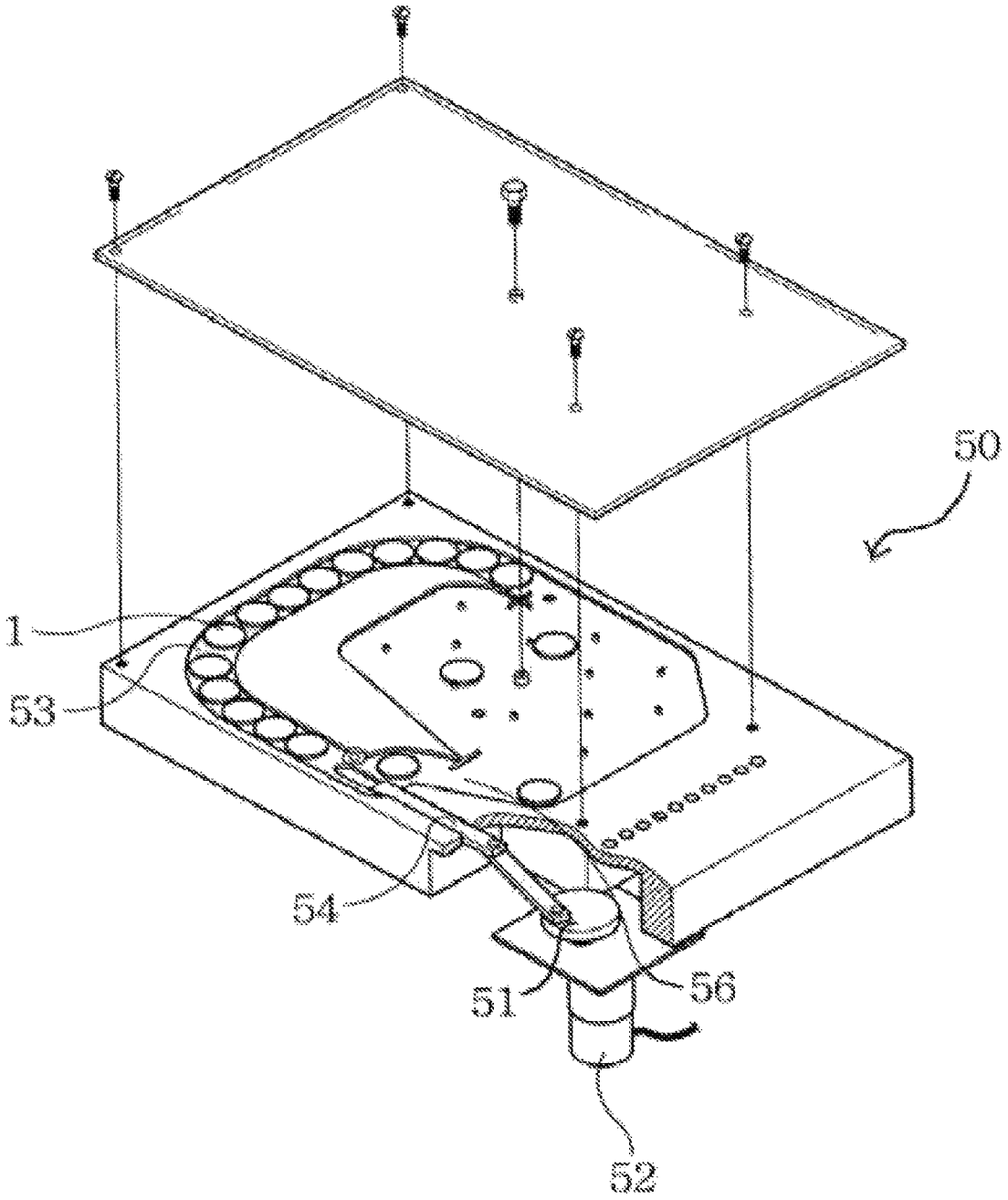
FIG. 1 is a view showing a medal circulation device of the related art.

Referring to FIG. 1, the guide unit 150 is periodically turned left and right about the eccentric shafts 151*a* and 152*a* by the motor (not shown).

The guide unit 150 turns left and right about the eccentric shafts, but may function as a door for restricting medals 300 supplied inside through the medal inlet 183.

For example, by setting one of the first guide 151 and the second guide 152 to close the medal inlet 183, it is possible to prevent a medal supplied inside through the medal inlet 183 from being supplied to the medal-dropping plate 180.

Obviously, it is also possible to control medals that are supplied into the medal inlet 183 using other door members.

Further, it is possible to convert rotation of a motor into left-right reciprocation using a cam, but it is not described in detail.

According to the present invention, it is required to keep operating the medal circulation plate 130 and the guide unit 150 when the game is in play, so the sensor unit 160 for sensing whether the medal circulation plate 130 and the guide unit 150 are operated or not is provided in the present invention.

The sensor unit 160 may include a rotation sensor 161 that senses rotation of the medal circulation plate 130, a turn sensor 162 that senses left and right turns of the guide unit 150, and a medal sensor 163 that senses whether there are medals in the medal seats 132.

The rotation sensor 161 senses whether the medal circulation plate 130 rotates, and transmits a signal to the controller 110. The controller 110 that has monitored rotation of the medal circulation plate 130 reverses the medal circulation plate 130 for a predetermined time so that the medal circulation plate 130 restarts rotating, when it is determined that the medal circulation plate 130 does not rotate during the game. Further, if the medal circulation plate 130 does not rotate after that, the controller 110 can sound an alarm through the sound unit 113 so that the reason of the malfunction can be solved.

The rotation sensor 161 is disposed at a position where it can sense rotation of the medal circulation plate 130 and the turn sensor 162 has only to sense left and right turns of the guide unit 150, so common sensors can be used for the sensors, and thus the detailed description thereof is not provided.

The medal sensor 163 determines whether there are medals 300 in the medal seats 132 so that an accurate number of medals 300 for a bet can be supplied into the medal inlet 183.

Accordingly, the medal sensor 163 should be disposed close to the medal inlet 183 to be able to determine whether there are medals 300 in the medal seats 132 approaching the medal inlet 183.

Referring to FIG. 2, assuming that the medal circulation plate 130 rotates clockwise, the medal sensor 163 is disposed at the left side from the medal inlet 183 to sense medals 300 in the medal seats 132.

The controller 110 determines whether there are medals 300 sensed by the medal sensor 163 and controls rotation of the medal circulation plate 130 so that an accurate number of medals can be supplied into the medal inlet 183.

That is, the controller 110 controls the rotation of the medal circulation plate 130 so that as many medals as the number of empty medal seats are further supplied.

The input unit 111 has buttons for operating the medal circulation device of the present invention, but, in particular, has buttons for controlling the speed of the medal circulation plate 130.

For example, a power button for controlling start/stop, an automatic button for constant rotation at a predetermined speed, and a manual button for moving the medal seats 132 to the medal inlet 183 may be provided.

The medal detectors 140 detect medals 300 passing the medal detectors 140 with the direction changed by fixed upper pins 181 and each have a passing score set in advance.

When the controller 110 calculates a set score as a game score and displays it on the score display 115 when receiving a sensing signal from a medal detector 140, and when the game is over, a medal corresponding to the accumulated score is discharged to the medal coin dispenser 112.

Further, in order to prevent medals 300 passing the medal detectors 140 from being stacked over the medal outlet 184, one or more lower pins 181 may be disposed under the medal detectors 140 so that the directions of the medals 300 that have passed the medal detectors 140 are changed again by the lower pins 181.

That is, the pins 180 are divided into the upper pins 182 and the lower pins 181 with respect to the medal detectors 140.

Accordingly, it is required to make the gaps and the numbers different between the upper pins 182 and the lower pins 181.

For example, the upper pins 182 are disposed to cover the entire dropping area of the medals to change the directions of all the medals dropping through the guide unit 150, while the lower pins 182 are disposed only over the medal outlet 182 because they have only to prevent medals from being stacked over the medal outlet 184.

Further, the medals 300 come in contact with the medal detectors 140 when passing them, so if the medals 300 pass the medal detectors 140 for a long period of time in this way, the surfaces of the medal detectors 140 are contaminated, so the medal detectors 140 may not detect the medals 300.

According to the present invention, in order to prevent this problem, the medals are made of a magnetic substance and the medal detectors 140 are configured to be able to detect magnetic substances so that they can effectively sense the medals even though they are used for a long period of time.

That is, the medal detectors 140 are magnetic sensors for detecting the gauss of magnetic substances passing them.

To this end, the medals 300 may be made of a magnetic substance having 1200~2000 Gauss and the medal detectors 140 may be made to be able to detect medals when 150 Gauss or more is sensed by magnetic sensors.

For example, the medal detectors may be gauss meters to determine whether a medal passes or not in accordance with measured flux density.

Various methods may be used to determine whether a magnetic substance passes or not. That is, it may be possible to sense a medal 300 on the basis of a change in inductance when the medal 300 drops, by providing a coil to the medal detectors 140.

Accordingly, the present invention is characterized by giving magnetism to medals.

The configuration of a medal of the present invention is described hereafter with reference to the drawings.

Figure 9:
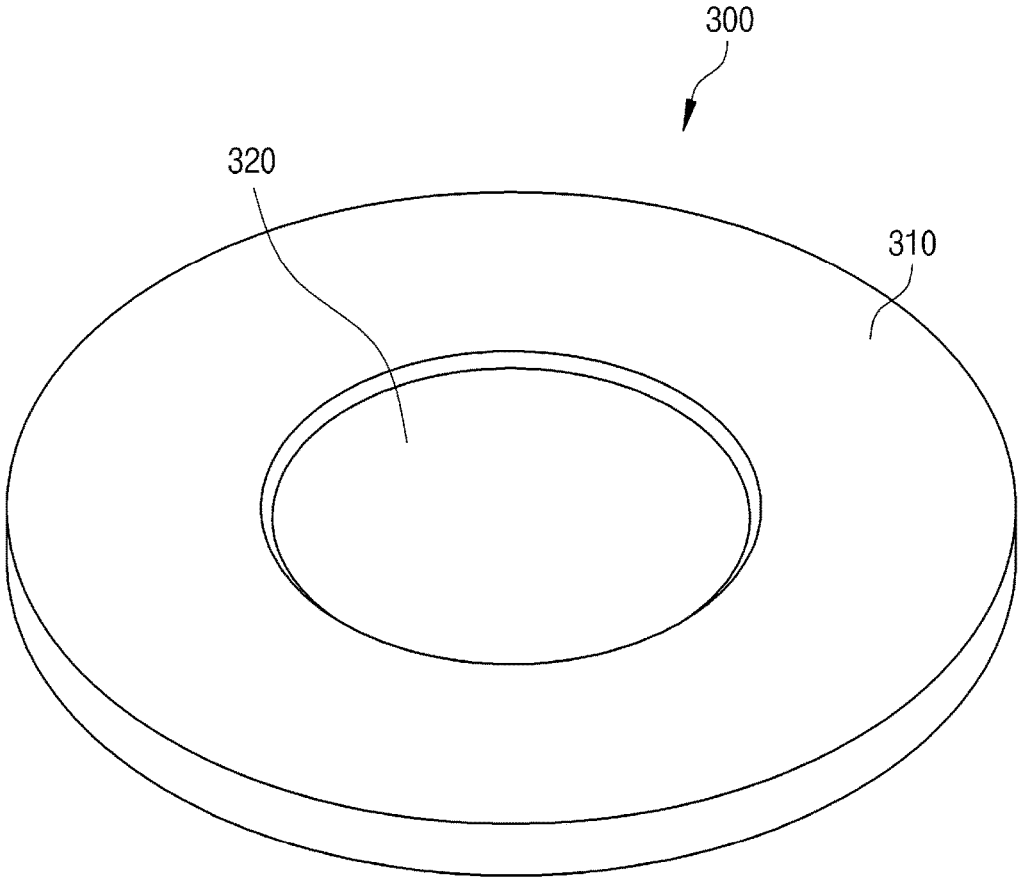
FIG. 9 is a perspective view of a medal according to an embodiment of the present invention.

FIG. 9 is a perspective view showing a medal 300 according to an embodiment of the present invention, in which the medal 300 includes a magnetic member 320 and a bracket 310 surrounding the magnetic member 320.

The bracket 310 is made of metal such as brass and covers the magnetic member 320 to protect the magnetic member 320 such that the magnetic member 320 can slide over the medal detectors 140.

Further, the bracket 310 has a circular outer shape to easily change by hitting the upper and lower pins 182 and 181 while dropping on the medal-dropping plate 180 and has a hollow seat therein to mount the magnetic member 320.

Figure 10:
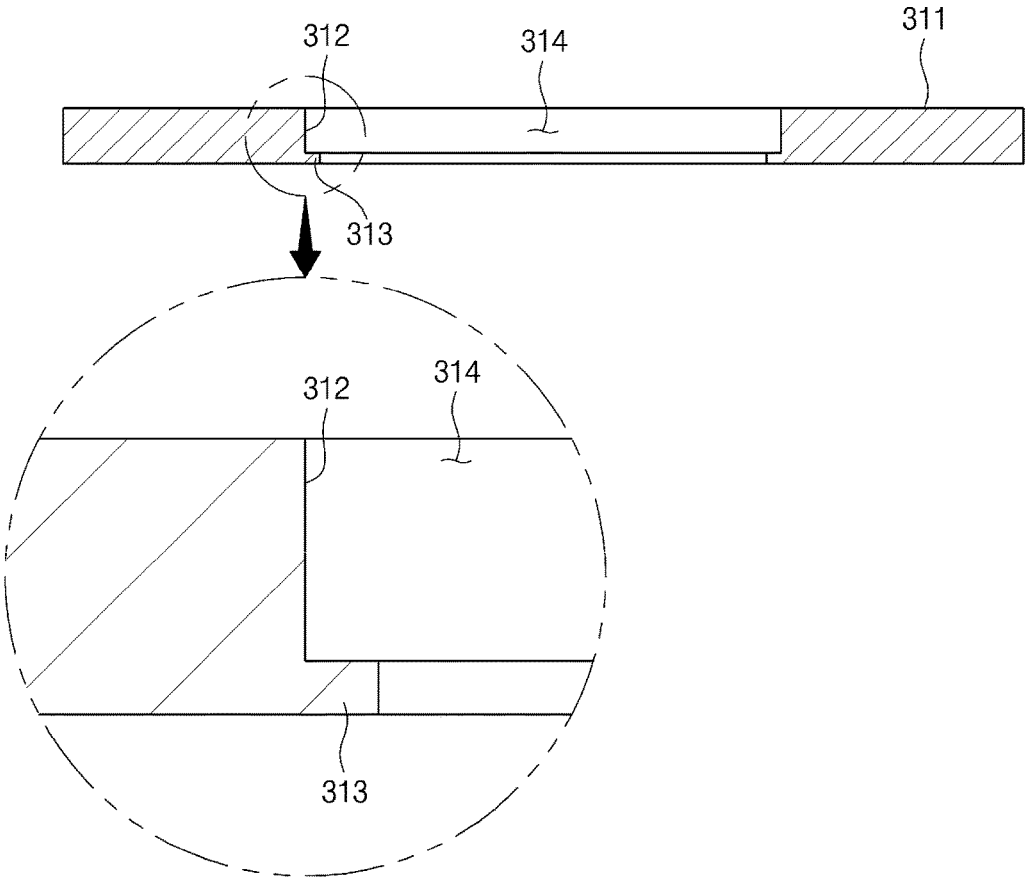
FIGS. 10 to 12 are views illustrating a process of manufacturing the medal.
Figure 11:
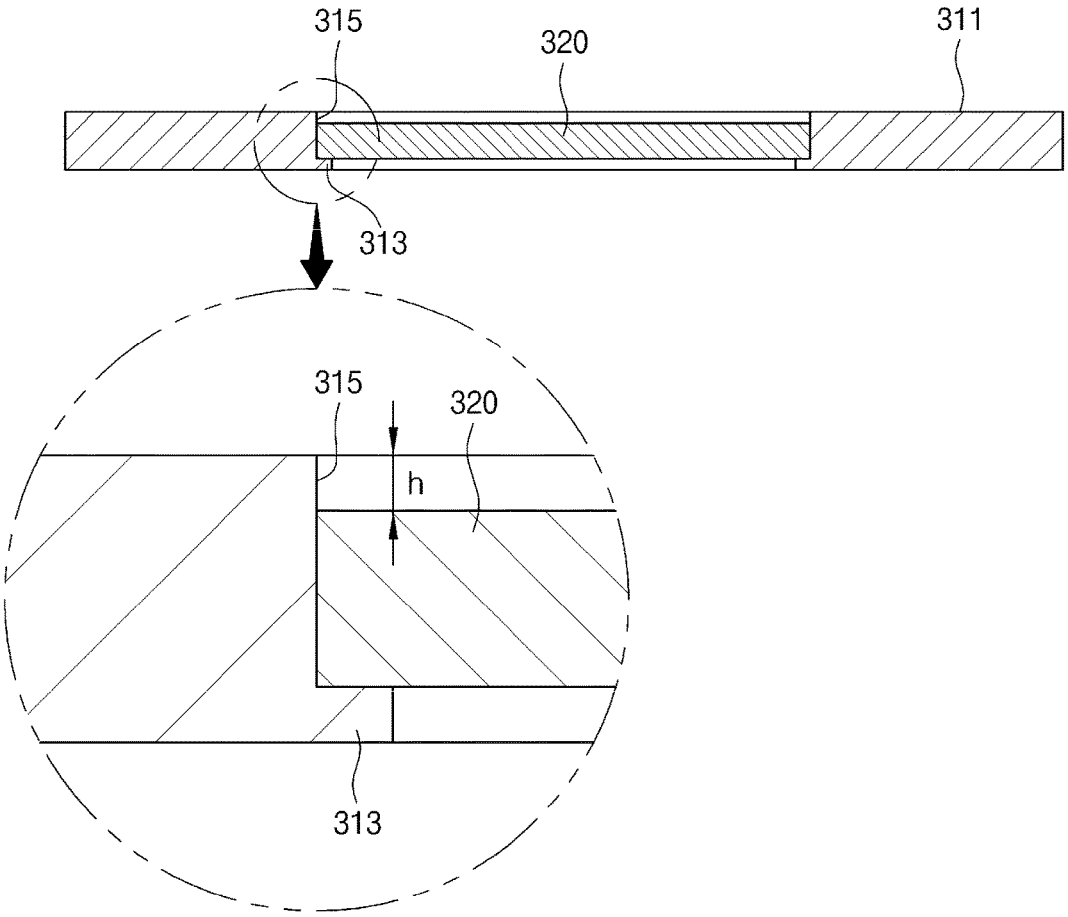
Figure 12:
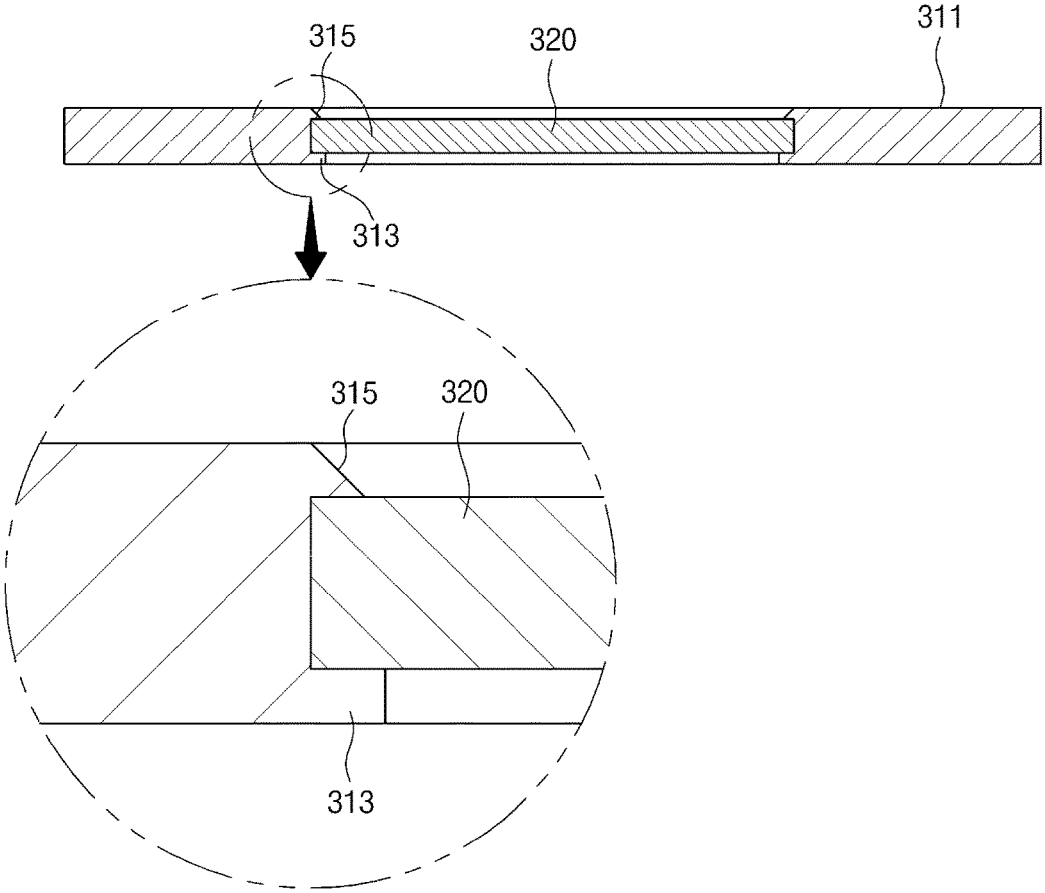

Referring to FIGS. 10 to 12 illustrating a process of manufacturing the medal, the bracket 310 has a circular body 311 and the circular hollow seat 314 inside the body 311, in which the lower end of the hollow seat 314 is supported on a step 313.

Referring to the enlarge view in FIG. 10, the step 313 protruding toward the center is formed at a lower portion around the inner wall 312 of the circular body so that the rear side of the magnetic member 320 is supported by the step 313 when the magnetic member 320 is mounted in the hollow seat 314.

Referring to FIG. 11, the circular magnetic member 320 is mounted in the hollow seat 314 and the rear side of the magnetic member 320 is supported by the step 313.

Further, referring to FIG. 11, the height of the inner wall 312 of the circular body has a predetermined spare height 'h' from the top of the magnetic member 320 such that a pressing portion 315 is formed to fix the magnetic member 320 to the upper portion of the circular body 311 when the magnetic member 320 is mounted.

That is, the circular magnetic member is mounted in the hollow seat 314 and supported on the step 313 and the pressing portion 315 is pressed by a pressing machine, so the magnetic member 320 is pressed and fixed by the step 313 at the bottom and the pressing portion 315 at the top.

Referring to FIG. 12, it can be seen that the pressing portion 315 presses a portion of the top around the outer circumferential side of the magnetic member 320.

On the other hand, one of the medal detectors 140 may be set to start a bonus game or an additional game so that when it is determined that a medal has passed the medal detector set to start the additional game, the controller starts the additional game after ending the current game.

Further, the controller 110 can display a made score on the score display 115, start an additional game, or provide a gift, depending on signals from the medal detectors 140.

The operation of the medal circulation device having the configuration described above is described hereafter.

When a user puts game money into a medal-coil/bill slot 114, the controller 110 operates the first driving unit 120 and the second driving unit 122 so that the medal circulation plate 130 rotates and the guide unit 150 turns left and right.

When a medal in the medal seats 132 of the medal circulation plate 130 reaches the top of the medal-dropping plate 180, the medal drops to the guide unit 150 through the medal inlet 183.

The guide unit 150 passes the medal in a predetermined direction while turning left and right and the passed medal is changed again in direction by the upper pins 182 while dropping and then passes a medal detector 140.

In this process, not all medals pass the medal detectors 140.

Referring to FIG. 2, medals may pass through the left and right spaces from the arrangement of the medal detectors 140 without passing the medal detectors 140.

When the medal passes a medal detector 140, the controller 110 displays the score set for the medal detector 140 on the score display 115, and when the passing medal is not the first one, an accumulated score is displayed.

Meanwhile, some of medals that have passed the medal detectors 140 bounce from the lower pins 181 and the others are discharged through the medal outlet 184 and drop into the medal seats 132 of the medal circulation plate 130, so they are returned to be supplied into the medal inlet 183.

The controller 110 determines the time or the number of times the game can be played in accordance of the value of the money put into the medal coin/bill slot 114, and when determining that the game is over, the controller 110 discharges a medal corresponding to the score displayed on the score display 115 to the medal coin dispenser 112.

The medal circulation device may operate as one game machine, but another aspect of the present invention is to provide an amusement machine using the medal circulation device for a user to play another game using the medal or medals that are supplied in accordance with the result of the game played with the medal circulation device.

To this end, an amusement machine using the medal circulation device may include the medal circulation device 100 that gives a score when a dropping medal passes a medal detector and returns the dropped medal to the top to drop it again, a medal supply unit 250, and a game plate 200 that plays a game with a medal supplied from the medal supply unit 250.

Figure 13:
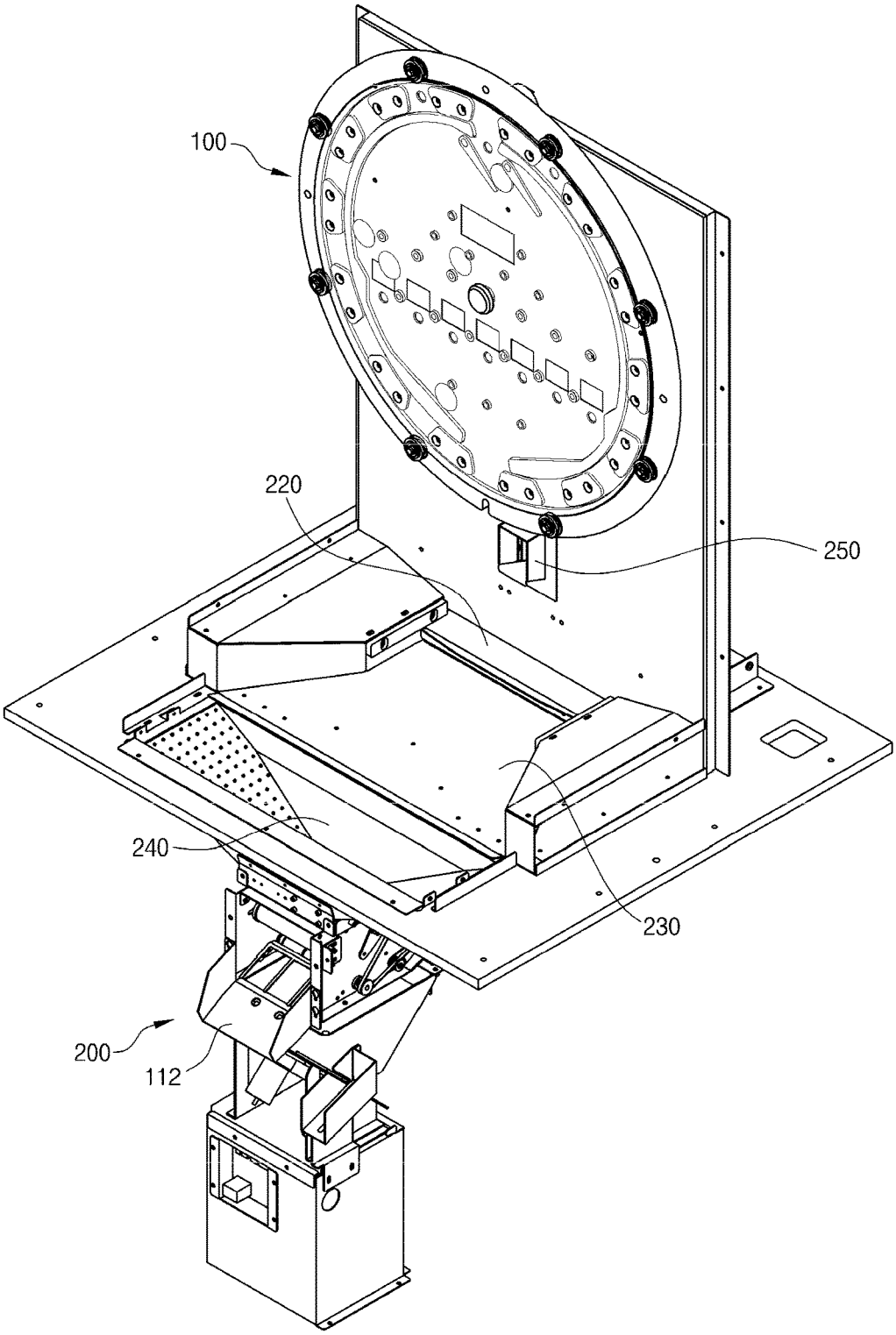
FIG. 13 is a view showing an example of an amusement machine using the medal circulation device.

Referring to FIG. 13 showing an example of an amusement machine using the medal circulation device, a medal obtained as a result of game in the medal circulation device 100 is supplied to the game plate 200 through the medal supply unit 250.

The amusement machine using a medal circulation device of the present invention may include all kinds of game machines that can be operated by medals, but a medal pusher game machine is exemplified for the convenience of description.

Figure 14:
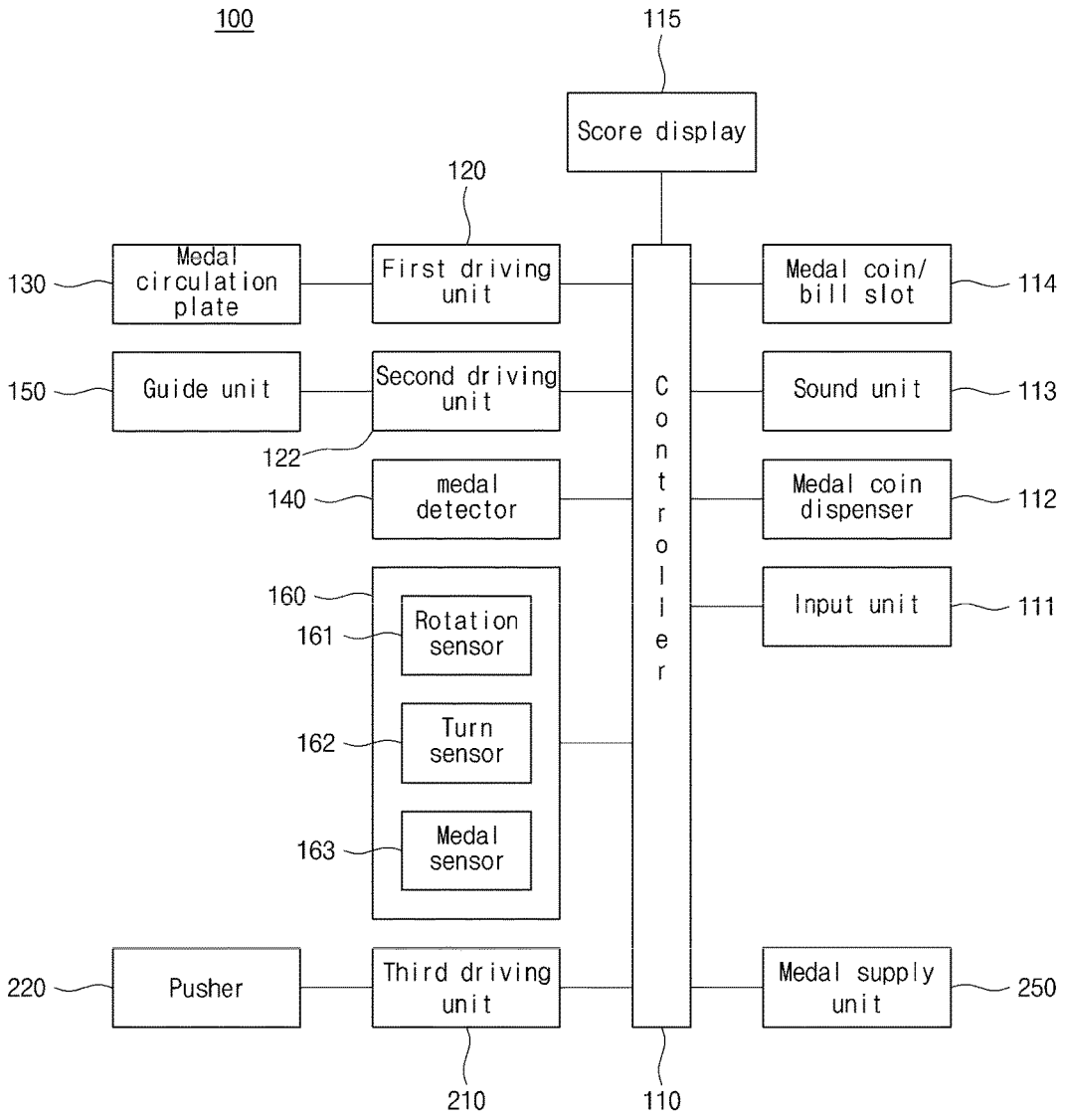
FIG. 14 is a view showing the main configuration of the medal amusement machine using the medal circulation device.

Referring first FIG. 14 showing the main configuration of an amusement machine using a medal circulation device may further include a third driving unit 210 for operating the medal supply unit 250 and a pusher 220 in the medal circulation device 100.

The medal circulation device is given the same configuration and the same reference numerals, so additional description is not provided.

However, medals obtained as a result of a game in the medal circulation device 100 are not discharged, but supplied to the game plate 200, so a user can enjoy another game.

Accordingly, the medal circulation device 100 is not described in detail here and the game plate 200 is described with reference to the drawings.

The medal pusher game plate 200 may include a collecting board 230 for collecting medals supplied through the medal supply unit 250, a pusher 220 for pushing and discharging medals collected on the collecting board 230, and a medal coin dispenser 112 for dispensing medals pushed into a hopper 240 by the pusher 220.

The medal supply unit 250, which is a device for supplying medals obtained as a result of the game in the medal circulation device 100, is formed at a side of the support frame 190 or collects medals on the collecting plate 230 using a specific supply member.

The pusher 220 pushes and discharges the medals collected on the collecting board 230 by reciprocating, the pushed medals drop into the hopper 240, and the medal dropping into the hopper 240 is dispensed through the medal coin dispenser 112.

According to the medal circulation device of the present invention described above, medals are sequentially and automatically supplied and the directions of dropping medals can be variously changed, so it is possible to provide a more interesting game.

According to the present invention a user can enjoy a game primarily through the medal circulation device and enjoy another game using a medal obtained as a result of the game, so the user can enjoy an additional game with one bet, and accordingly, it is possible to actively provide various games.

Although an exemplary embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A medal circulation device comprising:

a support frame;

a medal-dropping plate coupled to the support frame and having a medal inlet and a medal outlet; and a medal circulation plate collecting medals discharged through the medal outlet and putting the medals into the medal inlet, wherein the medal includes a magnetic member and a bracket covering the magnetic member, wherein the medal-dropping plate includes a guide unit guiding medals put into the medal inlet, and one or more pins changing directions of medals dropping through the guide unit; and the guide unit is turned left and right about eccentric shafts by a motor or operates as a door for restricting medals that are put inside through the medal inlet.

2. The device of claim 1, further comprising a power button for rotating and stopping the medal circulation plate.

3. The device of claim 1, wherein the medal-dropping plate further includes:

medal detectors sensing medals with directions changed by the pins and each having a score set in advance; and a controller calculating and displaying a score into a game score or discharging a medal corresponding to a score out of the device when receiving a signal from the medal detectors.

4. The device of claim 3, wherein any one or more of the medal detectors are set to start an additional game, and when it is determined that a medal has passed the medal detector set to provide the additional game, the controller starts the additional game after ending a current game.

5. The device of claim 1, wherein the support frame has a pair of semi-circular support brackets spaced from each other along an edge thereof to form the medal inlet and the medal outlet at upper and lower portions, respectively.

6. The device of claim 5, wherein a medal lane is formed between the support brackets and the support frame and the medal circulation plate rotates along the medal lane.

7. The device of claim 6, wherein the medal circulation plate includes:

a circular transparent cover coupled through a shaft to a motor on a rear side of the medal-dropping plate and disposed over a front side of the medal-dropping plate;

brackets arranged with regular intervals along an outer circumferential side of the transparent cover; and fasteners coupling the transparent cover and the brackets to each other.

8. The device of claim 7, wherein the medal circulation plate has one or more medal seat where medals discharged through the medal outlet are placed, and the medals placed in the medal seats are rotated along the medal lane.

9. The device of claim 7, further comprising one or more rollers arranged along an outer circumferential side of the support frame, wherein the outer circumferential side of the transparent cover is supported in contact with the rollers.

10. The device of claim 1, wherein the guide unit includes a pair of first and second guides, and the first guide and the second guide are turned left and right about eccentric shafts by the motor on the rear side of the medal-dropping plate.

11. An amusement machine using a medal circulation device, comprising:

a medal circulation device giving a score when a dropping medal passes a detector and returning the dropped medal to drop the medal again;

a medal supply unit supplying a medal corresponding to a passing score given by the medal circulation device; and a game plate playing a game with the medal supplied from the medal supply unit, wherein the medal circulation device includes:

a medal-dropping plate having a medal inlet, a guide unit guiding medals put into the medal inlet, one or more pins changing directions of medals dropping through the guide units, and a medal outlet discharging medals passing through the pins; and a medal circulation plate collecting the medals discharged through the medal outlet to return the medals into the medal inlet; and wherein the medal circulation plate has medal seats for placing the medals discharged through the medal outlet, and the medals placed in the medal seats are delivered through a medal lane formed between the medal-dropping plate and the support frame.

12. The amusement machine of claim 11, wherein the medal-dropping plate further includes:

medal detectors sensing medals with directions changed by the pins and each having a score set in advance; and a controller making the medal supply unit discharge a medal corresponding to a score when receiving a signal from the medal detectors.

13. The amusement machine of claim 11, wherein the guide unit includes a pair of first and second guides, and the first guide and the second guide are turned left and right about shafts by the motor on the rear side of the medal-dropping plate.

14. The amusement device of claim 11, wherein the game plate includes:

a collecting plate collecting medals supplied from the medal supply unit;

a pusher pushing and discharging medal collected on the collecting plate; and a medal dispenser dispensing the medals pushed and discharged by the pusher.

15. A medal circulation device comprising:

a support frame;

a medal-dropping plate coupled to the support frame and having a medal inlet and a medal outlet; and a medal circulation plate collecting medals discharged through the medal outlet and putting the medals into the medal inlet, wherein the medal includes a magnetic member and a bracket covering the magnetic member, wherein the support frame has a pair of semi-circular support brackets spaced from each other along an edge thereof to form the medal inlet and the medal outlet at upper and lower portions, respectively;

a medal lane is formed between the support brackets and the support frame and the medal circulation plate rotates along the medal lane; and wherein the medal circulation plate includes:

a circular transparent cover coupled through a shaft to a motor on a rear side of the medal-dropping plate and disposed over a front side of the medal-dropping plate;

brackets arranged with regular intervals along an outer circumferential side of the transparent cover; and fasteners coupling the transparent cover and the brackets to each other.

16. The device of claim 15, wherein the medal circulation plate has one or more medal seat where medals discharged through the medal outlet are placed, and the medals placed in the medal seats are rotated along the medal lane.

17. The device of claim 15, further comprising one or more rollers arranged along an outer circumferential side of the support frame, wherein the outer circumferential side of the transparent cover is supported in contact with the rollers.

18. An amusement machine using a medal circulation device, comprising:

a medal circulation device giving a score when a dropping medal passes a detector and returning the dropped medal to drop the medal again;

a medal supply unit supplying a medal corresponding to a passing score given by the medal circulation device; and a game plate playing a game with the medal supplied from the medal supply unit, wherein the medal circulation device includes:

a medal-dropping plate having a medal inlet, a guide unit guiding medals put into the medal inlet, one or more pins changing directions of medals dropping through the guide units, and a medal outlet discharging medals passing through the pins; and a medal circulation plate collecting the medals discharged through the medal outlet to return the medals into the medal inlet;

wherein the guide unit includes a pair of first and second guides, and the first guide and the second guide are turned left and right about shafts by the motor on the rear side of the medal-dropping plate.

* * * * *